US010365029B2

(12) United States Patent
Grenier et al.

(10) Patent No.: US 10,365,029 B2
(45) Date of Patent: Jul. 30, 2019

(54) INSULATED FRAME SECTION AND REFRIGERATOR DOOR SYSTEM CONSTRUCTED FROM SUCH SECTIONS

(71) Applicant: EDC Energy Door Company, L'assomption (CA)

(72) Inventors: Mathieu Grenier, Repentigny (CA); Vincent Cormier, Repentigny (CA)

(73) Assignee: EDC Energy Door Company, L'assomption (CA)

( * ) Notice: Subject to any disclaimer, the term of this patent is extended or adjusted under 35 U.S.C. 154(b) by 8 days.

(21) Appl. No.: 15/693,603

(22) Filed: Sep. 1, 2017

(65) Prior Publication Data

US 2019/0072314 A1 Mar. 7, 2019

(51) Int. Cl.

| | |
|---|---|
| ***E06B 1/18*** | (2006.01) |
| ***F25D 23/02*** | (2006.01) |
| ***F25D 23/06*** | (2006.01) |
| ***E06B 5/00*** | (2006.01) |
| ***E06B 1/32*** | (2006.01) |

(52) U.S. Cl.

CPC ..... *F25D 23/028* (2013.01); *E06B 1/18* (2013.01); *E06B 1/325* (2013.01); *E06B 5/00* (2013.01); *F25D 23/067* (2013.01)

(58) Field of Classification Search

CPC ..... F25D 23/028; F25D 23/067; E06B 1/18; E06B 1/325; E06B 5/00

See application file for complete search history.

(56) References Cited

U.S. PATENT DOCUMENTS

| | | | | |
|---|---|---|---|---|
| 3,722,928 | A * | 3/1973 | Skubic | E04B 2/7433 217/43 A |
| 4,688,366 | A * | 8/1987 | Schmidt | E06B 3/2675 264/261 |
| 4,940,297 | A * | 7/1990 | Borgen | A47F 3/043 312/116 |
| 5,097,642 | A * | 3/1992 | Richardson | A47F 3/043 52/171.3 |
| 5,647,181 | A * | 7/1997 | Hunts | A63H 33/10 312/111 |
| 5,778,689 | A * | 7/1998 | Beatenbough | A47F 3/043 219/218 |
| 6,301,913 | B1 * | 10/2001 | Schulak | A47F 3/0434 62/248 |
| 7,096,640 | B1 * | 8/2006 | Chevian | E06B 3/2675 52/204.591 |
| D612,517 | S | 3/2010 | Nicholson | |

(Continued)

OTHER PUBLICATIONS

Anthony (A Dover Company); 101B, 210X, ELM, 101X Frame Installation & Service Manual; 2011.

*Primary Examiner* — Paola Agudelo

(74) *Attorney, Agent, or Firm* — BCF LLP

(57) ABSTRACT

The present disclosure relates to an insulated frame section. The frame section comprises an elongate interior frame member, an elongate exterior frame member and an elongate insulation element connected to the interior frame member and to the exterior frame member. The insulation element prevents any direct physical contact between the interior and exterior frame members. A refrigerator door system having a door and a door frame constructed from such insulated frame sections is also disclosed.

14 Claims, 9 Drawing Sheets

(56) References Cited

U.S. PATENT DOCUMENTS

| | | | | |
|---|---|---|---|---|
| 8,613,161 | B2 * | 12/2013 | Nicholson | A47F 3/0434 312/116 |
| 8,826,616 | B1 * | 9/2014 | Gosselin | E06B 3/9616 52/204.5 |
| 8,997,412 | B1 * | 4/2015 | Header | E06B 1/524 52/204.71 |
| 9,328,549 | B1 * | 5/2016 | Alexander | E06B 1/325 |
| 9,526,353 | B2 | 12/2016 | Chubb | |
| 2002/0078654 | A1 * | 6/2002 | Richardson | A47F 3/0434 52/656.9 |
| 2007/0266655 | A1 * | 11/2007 | Howe | E04B 1/58 52/282.1 |
| 2008/0122324 | A1 | 5/2008 | Bienick | |
| 2008/0190046 | A1 | 8/2008 | Hecht et al. | |
| 2018/0038149 | A1 * | 2/2018 | Strickland | E06B 3/26305 |

* cited by examiner

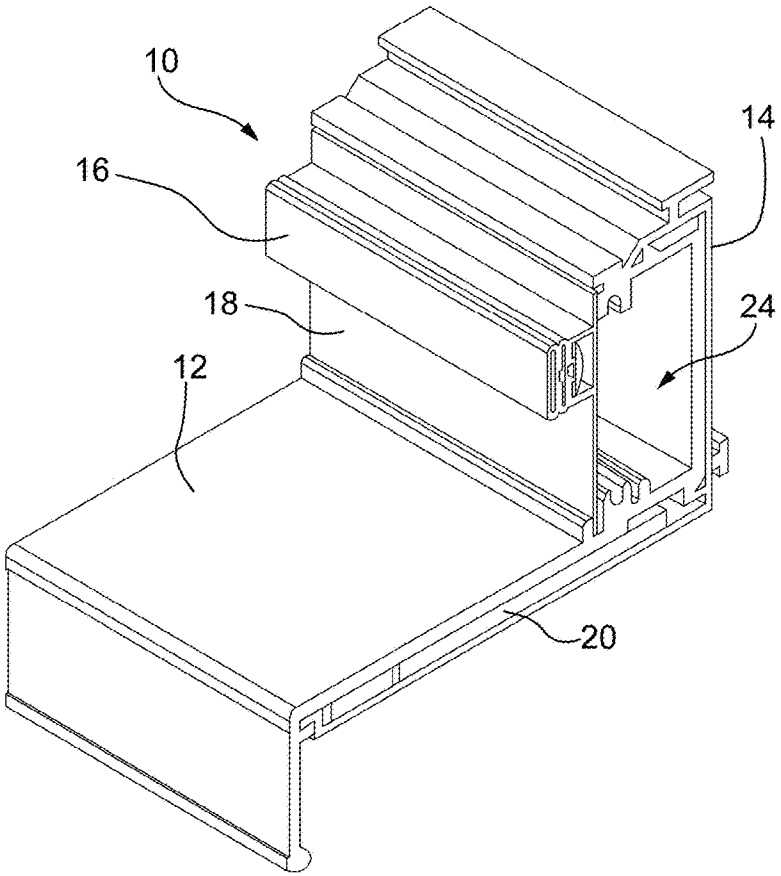
Figure 1b (Prior Art)
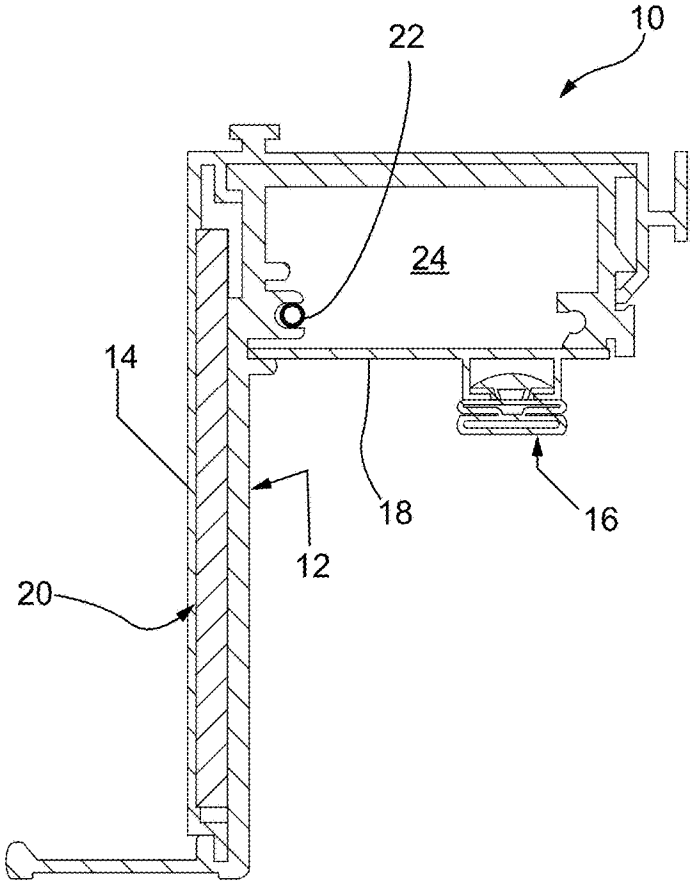
Figure 1a (Priot Art)

INSULATED FRAME SECTION AND REFRIGERATOR DOOR SYSTEM CONSTRUCTED FROM SUCH SECTIONS

TECHNICAL FIELD

The present disclosure relates to the field of refrigeration equipment. More specifically, the present disclosure relates to an insulated frame section and to a refrigerator door system constructed from such sections.

BACKGROUND

Large commercial refrigerators with glass doors are commonly found in grocery stores and convenience stores where food and drinks are stored for access to customers.

FIGS. 1*a* and 1*b* (Prior Art) are, respectively a top plan, cutaway view and a perspective view of a conventional frame section. The frame section 10 includes an external member 12, an internal member 14 and a gasket 16 mounted to the external member 12 via a gasket support 18. An edge of a door panel (not shown) on the cold side of the refrigerator sits on the gasket 16 when the door is closed. An insulating element 20 is inserted between the external and internal members 12, 14. Thermal bridges are formed by material of the external and internal members 12, 14, for example metal, that surround the insulating element 20.

Refrigerator door frames must be sturdy in order to withstand frequent and sometimes careless opening and closing by customers. For that reason, refrigerator doors are commonly made of steel or aluminum. Because these materials are good thermal conductors, condensation on glass door panels is a significant problem.

Shop owners desire to keep their glass doors free of any fogging in order to allow customers to clearly see the products that are available on refrigerator shelves. A common solution to the condensation problem is to install cable heating elements 22 within an open space 24 within refrigerator door frames. While this solution is effective in preventing condensation, it is highly inefficient in terms of energy consumption. Given the opposite requirements of keeping the inside of the refrigerator cold while keeping the door frames warm, electrical energy waste is considerable.

Therefore, there is a need for improvements in the construction of refrigerator door frames that compensate for problems related to condensation and to waste of energy.

SUMMARY

According to the present disclosure, there is provided an insulated frame section. The frame section comprises an elongate interior frame member, an elongate exterior frame member and an elongate insulation element connected to the interior frame member and to the exterior frame member. The insulation element prevents any direct physical contact between the interior and exterior frame members.

According to the present disclosure, there is also provided a refrigerator door system. The refrigerator door system comprises a door frame comprising four frame sections assembled to form a rectangular opening. Each frame section comprises an elongate interior frame member, an elongate exterior frame member and an elongate insulation element connected to the interior frame member and to the exterior frame member, the insulation element preventing any direct physical contact between the interior and exterior frame members. The refrigerator door system also comprises a door mounted to the door frame. The door comprises a transparent window mounted between a pair of stiles and a pair of rails.

The present disclosure further relates to a refrigerator door system. The refrigerator door system comprises a door frame comprising four frame sections assembled to form a rectangular opening. Each frame section comprises an elongate interior frame member, an elongate exterior frame member and an elongate insulation element connected to the interior frame member and to the exterior frame member, the insulation element preventing any direct physical contact between the interior and exterior frame members. The refrigerator door system also comprises two doors. Each door comprises a pair of hinges adapted for mounting the door to the door frame. Each door further comprises a transparent window mounted between a pair of stiles and a pair of rails. The two doors are mounted to the door frame so that their respective hinges are on opposite sides of the door frame.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which:

FIGS. 1*a* and 1*b* (Prior Art) are, respectively a top plan, cutaway view and a perspective view of a conventional frame section;

Like numerals represent like features on the various drawings.

DETAILED DESCRIPTION

Various aspects of the present disclosure generally address one or more of the problems of condensation and energy waste of commercial refrigerator doors.

In an aspect of the present technology, insulated frame sections for use in fabricating refrigerator door frames are constructed of an elongate exterior frame member adapted for mounting to a solid frame of the refrigerator, an elongate interior frame member adapted for receiving a gasket on which a refrigerator door will abut when closed, and an elongate insulation member. The interior frame member and the exterior frame member are both connected to the insulation member while not touching each other. In an embodiment, the interior and exterior frame member are made of aluminum, steel or other metal having sufficient rigidity to withstand frequent opening and closing of the refrigerator door. Such metal also has a very high thermal conductivity. The insulation member has very low thermal conductivity. It is constructed to a solid plastic material, for example polyvinyl chloride (PVC) or polypropylene, and has a compact cross-section to enhance its rigidity.

In the context of the present disclosure, the exterior frame member is at least in part located on a "warm" side of the refrigerator, being exposed to external heat sources when the door is closed. The interior frame member is generally or entirely located on a "cold" side of the refrigerator, being essentially insulated from outside heat sources when the door is closed.

Figure 2:
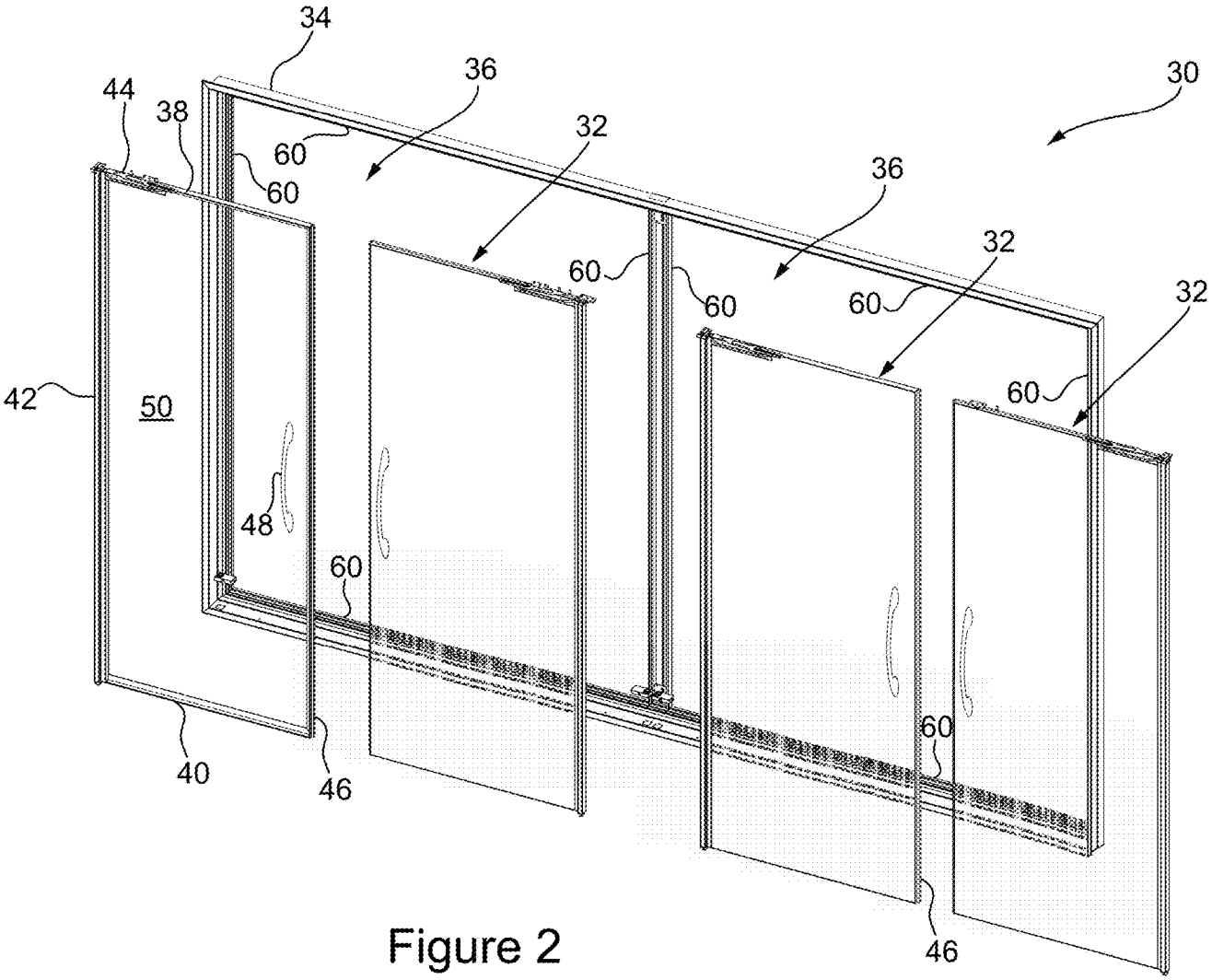
FIG. 2 is a perspective, exploded view of a refrigerator door system incorporating doors and a door frame constructed of insulated frame sections.

Referring now to the drawings, FIG. 2 is a perspective, exploded view of a refrigerator door system incorporating doors and a door frame constructed of insulated frame sections. A refrigerator door system 30 as shown includes four (4) glass doors 32 mounted in a door frame 34 having two (2) openings 36, each of the openings 36 receiving two (2) of the glass doors 32. Each door 32 includes a top rail 38, a bottom rail 40, a first stile 42 on which are mounted a pair of hinges 44 (only a top hinge 44 is shown, a bottom hinge not being shown), and a second stile 46. A door handle 48 is mounted on a glass window 50 near the second stile 46. The door frame 34 is constructed of insulated frame sections that will be described hereinbelow.

Figure 3:
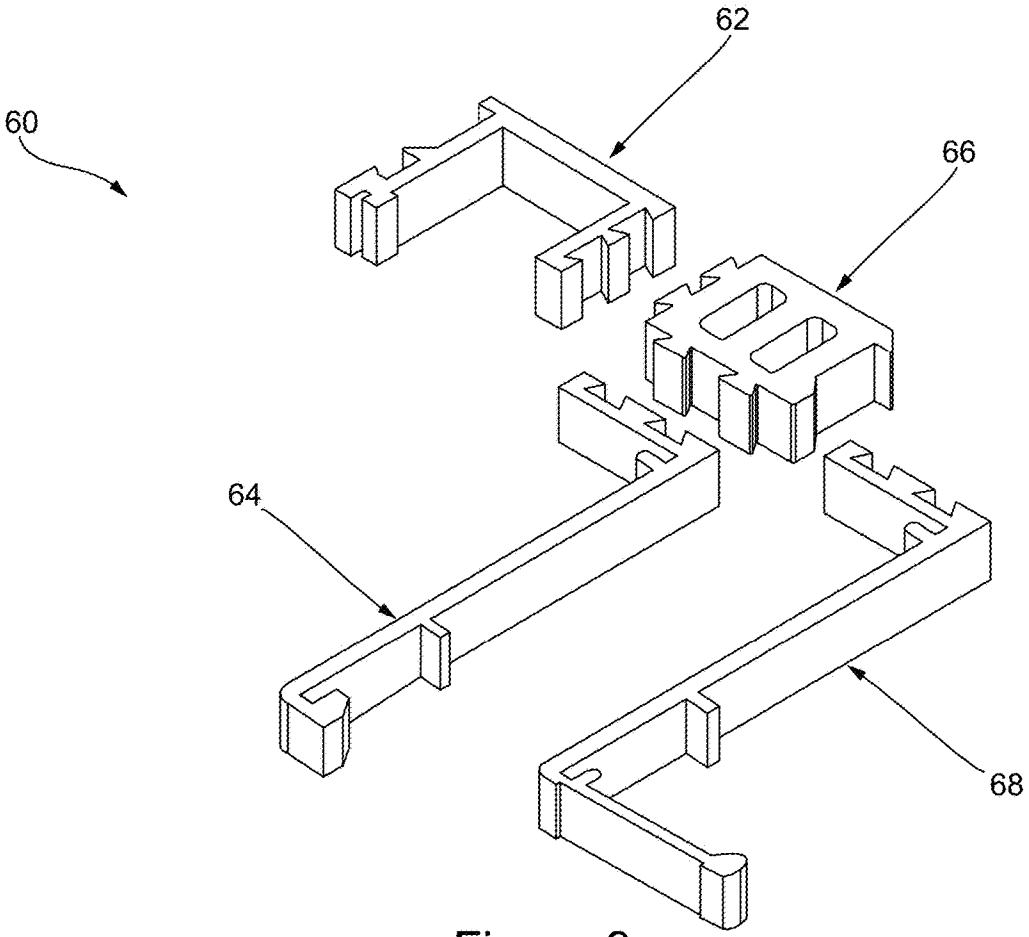
FIG. 3 is a perspective, exploded and cutaway view showing disassembled components of the insulated frame section.
Figure 5:
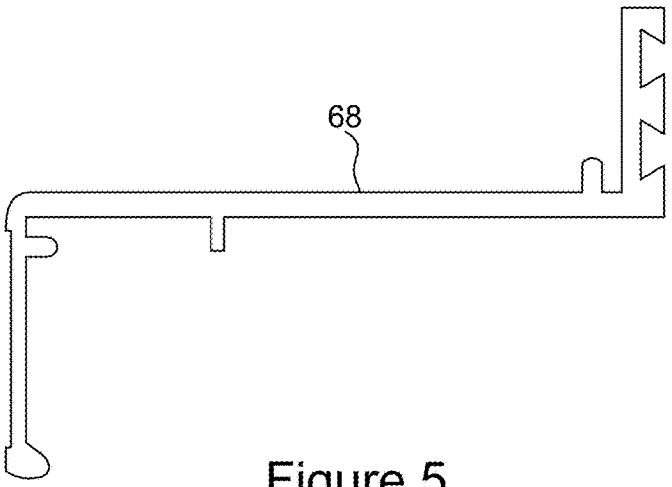
FIG. 5 is a top plan view of a top or bottom exterior frame end of the insulated frame section of FIG. 2.
Figure 4:
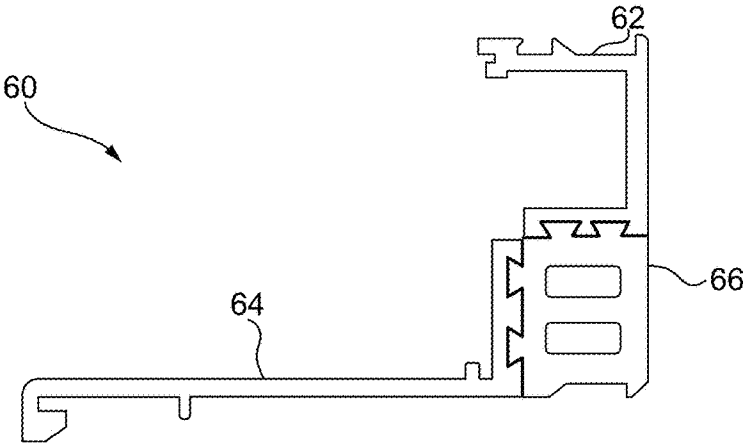
FIG. 4 is a top plan, cutaway view of the insulated frame section of FIG. 2.
Figure 6:
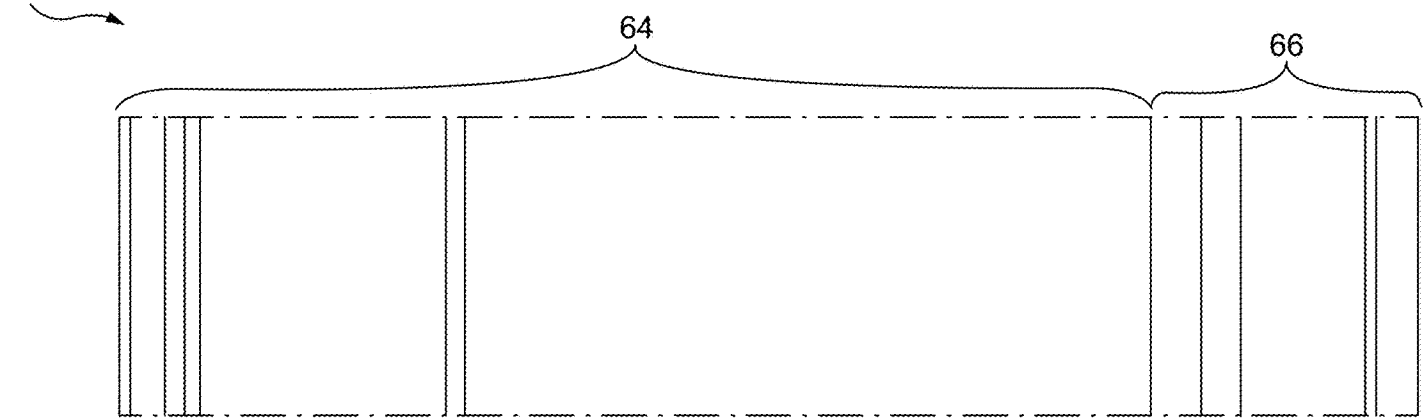
FIG. 6 is an elevation, cutaway view of the insulated frame section of FIG. 2.
Figure 7:
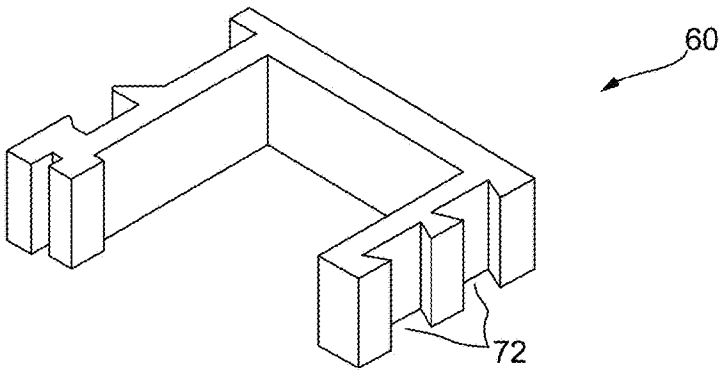
FIG. 7 is a perspective and cutaway view of an interior frame member of the insulated frame section of FIG. 2.
Figure 8:
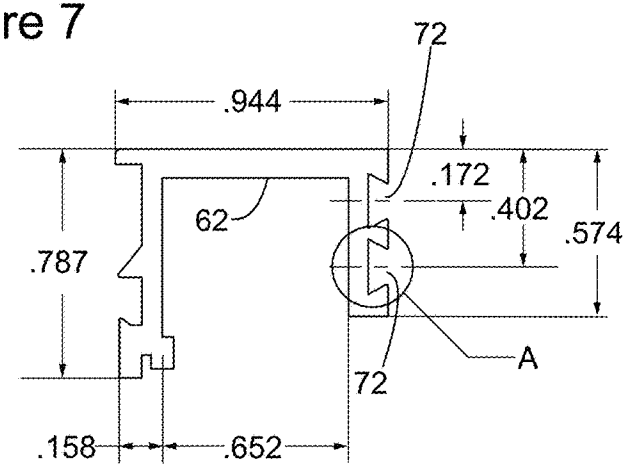
FIG. 8 is a top plan view of the interior frame member of FIG. 7.
Figure 9:
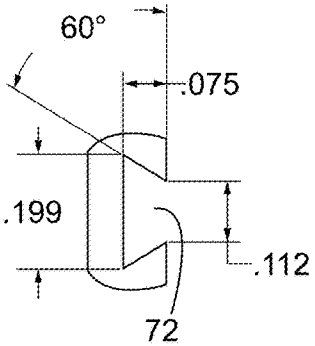
FIG. 9 is a detailed view of FIG. 8 at area A.
Figure 10:
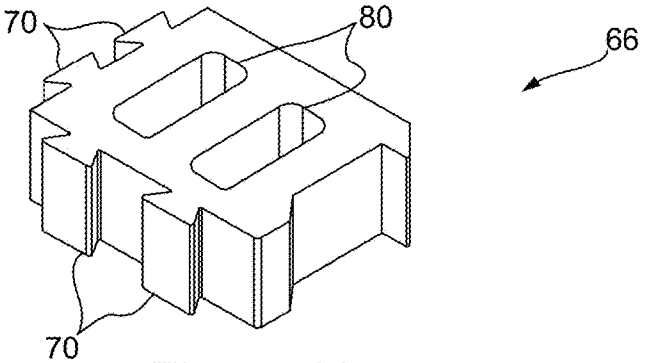
FIG. 10 is a perspective and cutaway view of an insulation element of the insulated frame section of FIG. 2.
Figure 11:
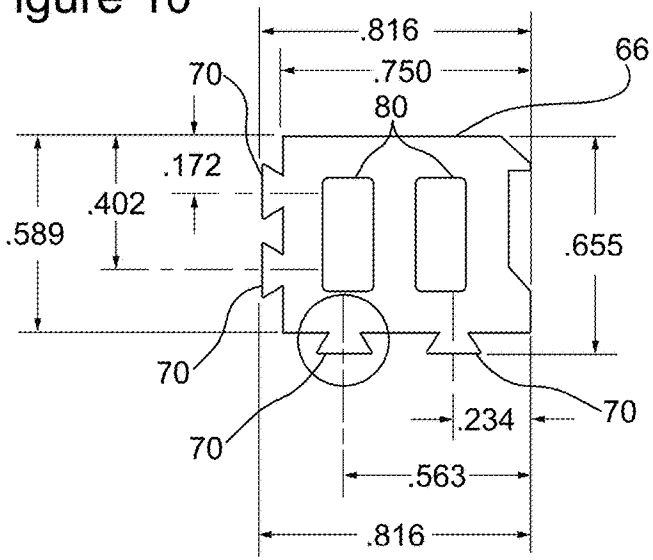
FIG. 11 is a top plan, cutaway view of the insulation element of FIG. 10.
Figure 12:
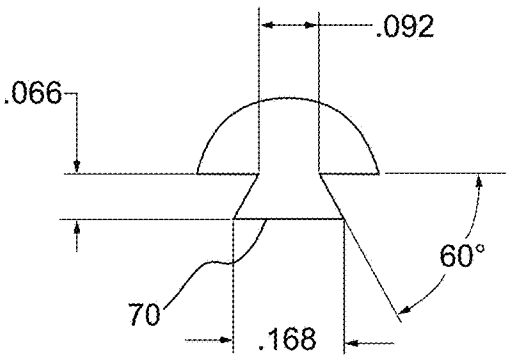
FIG. 12 is a detailed view of FIG. 11 at area B.
Figure 14:
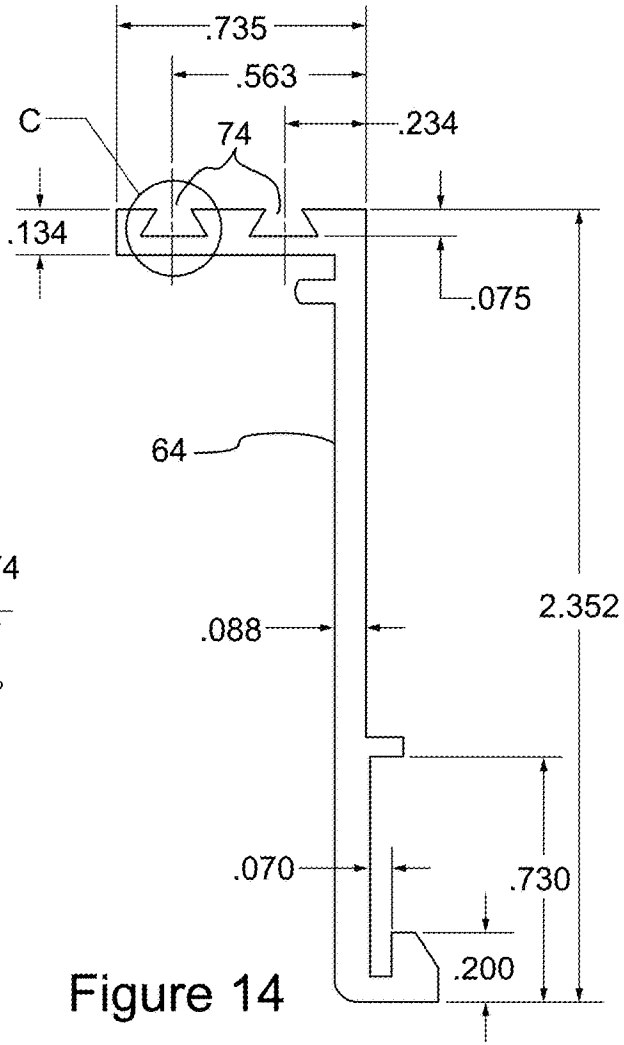
FIG. 14 is a top plan view of the exterior frame member of FIG. 13.
Figure 15:
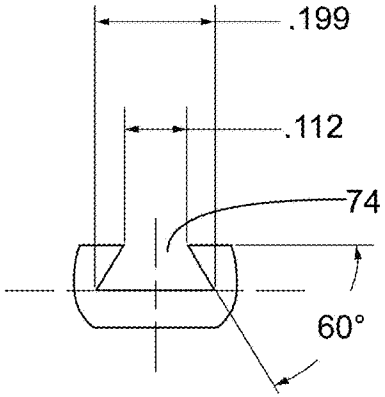
FIG. 15 is a detailed view of FIG. 14 at area C.
Figure 13:
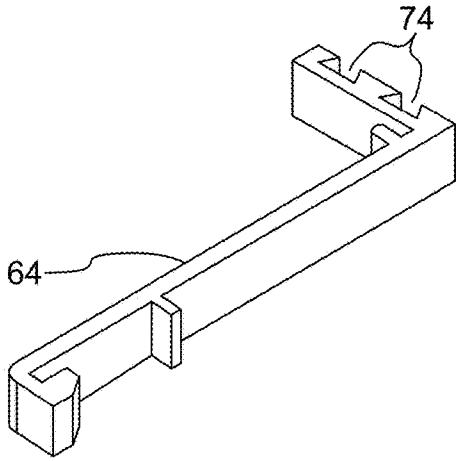
FIG. 13 is a perspective and cutaway view of the exterior frame member of the insulated frame section of FIG. 2.
Figure 17:
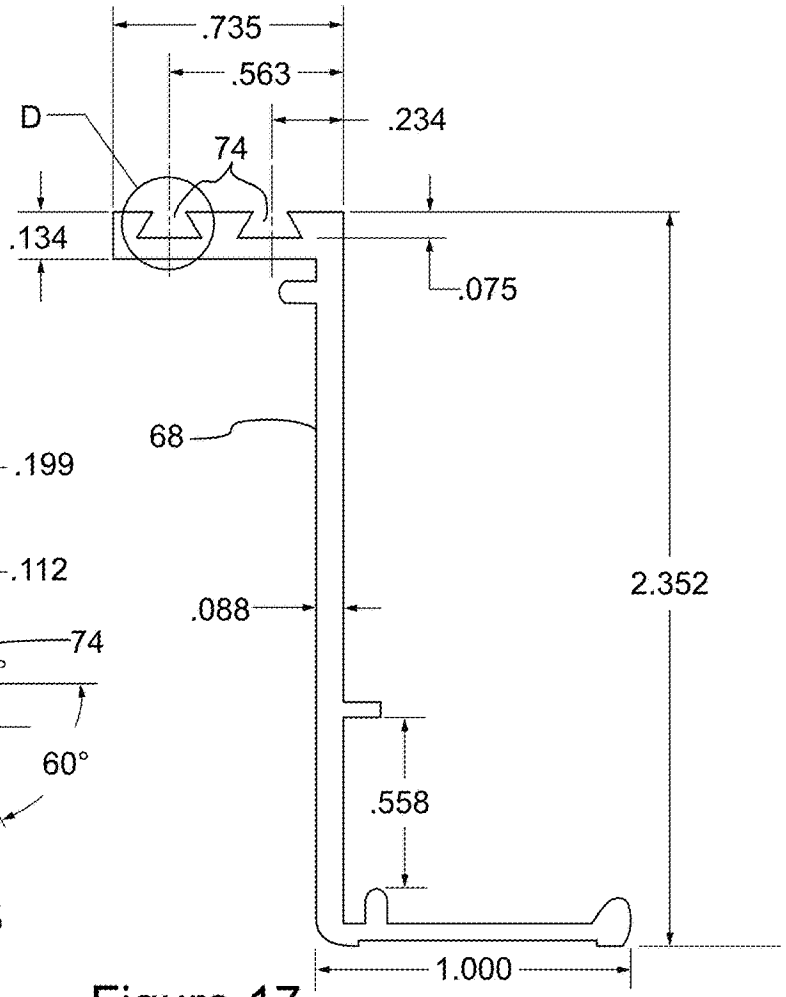
FIG. 17 is a top plan view of the top or bottom exterior frame end of FIG. 16.
Figure 18:
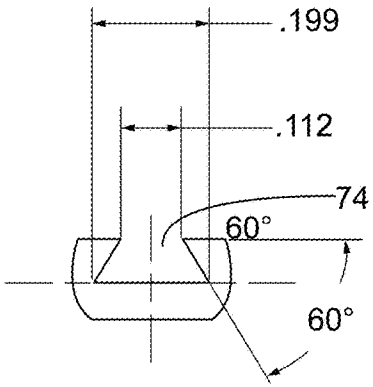
FIG. 18 is a detailed view of FIG. 17 at area D.
Figure 16:
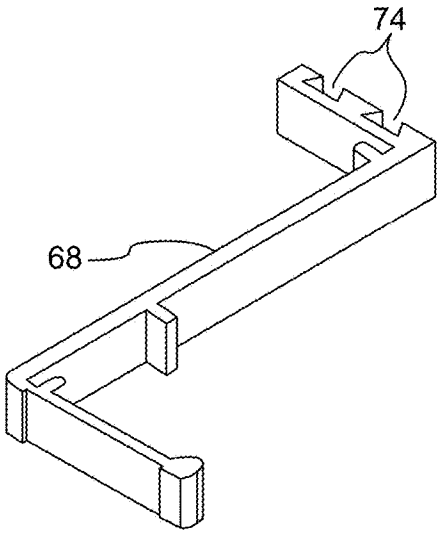
FIG. 16 is a perspective view of the top or bottom exterior frame end of the insulated frame section of FIG. 2.

FIG. 3 is a perspective, exploded and cutaway view showing disassembled components of the insulated frame section. FIG. 4 is a top plan, cutaway view of the insulated frame section of FIG. 2. FIG. 5 is a top plan view of a top or bottom exterior frame end of the insulated frame section of FIG. 2. FIG. 6 is an elevation, cutaway view of the insulated frame section of FIG. 2. FIG. 7 is a perspective and cutaway view of an interior frame member of the insulated frame section of FIG. 2. FIG. 8 is a top plan view of the interior frame member of FIG. 7. FIG. 9 is a detailed view of FIG. 8 at area A. FIG. 10 is a perspective and cutaway view of an insulation element of the insulated frame section of FIG. 2. FIG. 11 is a top plan, cutaway view of the insulation element of FIG. 10. FIG. 12 is a detailed view of FIG. 11 at area B. FIG. 13 is a perspective and cutaway view of the exterior frame member of the insulated frame section of FIG. 2. FIG. 14 is a top plan view of the exterior frame member of FIG. 13. FIG. 15 is a detailed view of FIG. 14 at area C. FIG. 16 is a perspective view of the top or bottom exterior frame end of the insulated frame section of FIG. 2. FIG. 17 is a top plan view of the top or bottom exterior frame end of FIG. 16. FIG. 18 is a detailed view of FIG. 17 at area D. Referring at once to FIGS. 3-18, in an embodiment as illustrated, an insulated frame section 60 comprises an elongate interior frame member 62, an elongate exterior frame member 64 and an elongate insulation element 66. The insulation element 66 forms a continuous union connecting the interior frame member 62 to the exterior frame member 64. The insulation element 66 prevents any direct physical contact between the interior and exterior frame members 62, 64. A frame end 68 may be placed at each extremity of the insulated frame section 60. In an alternate embodiment, the exterior frame member 64 can adopt, over its entire length, the same cross-section as that of the frame end 68, as shown on FIG. 5. In the context of the present disclosure, the term "elongate" when used to qualify a component of the insulated frame section is synonymous with "slender"; any element qualified by this term has a length that is significantly broader than its cross-section. Any one or all of the interior and exterior frame members and of the insulation element may be fabricated using an extrusion process.

In the embodiment as shown, the insulation element 66 is connected to the interior frame member 62 and to the exterior frame member 64 by dovetail joints. In more details, the insulation element 66 has a number of pins 70 that are sized and configured for insertion in tails 72 of the interior frame member 62 and in tails 74 of the exterior frame member 64 and of the frame end 68. This manner of connecting the interior and exterior frame members 62, 64 to the insulation element 66 is illustrative and non-limiting. In particular, a number of dovetail joints may be greater or smaller than as shown on the various drawings.

Dimensions shown on FIGS. 8, 9, 11, 12, 14, 15, 17 and 18 are in inches, except for angles which are in degrees. The values as shown are for a particular implementation and are provided herein as non-limitative examples.

At least one and generally both of the interior and exterior frame members 62, 64, as well as the frame end 68 are made of a material having a first level of thermal conductivity. The insulation element is made 66 of a material having a second level of thermal conductivity, the first level of thermal conductivity being greater than the second level of thermal conductivity. Non-limiting examples of materials that may be used to construct the insulated frame section are listed in Table I, in which thermal conductivity is expressed in terms of watts per meter-kelvin (W/(m-K)).

TABLE I

| Material | Use | Thermal Conductivity |
|---|---|---|
| Aluminum | Interior and exterior frame members | 205 |
| Magnesium | Interior and exterior frame members | 156 |
| Magnesium alloy | Interior and exterior frame members | 70-145 |
| PVC | Insulation element | 0.19 |
| Polypropylene | Insulation element | 0.1-0.22 |
| Nylon 6 | Insulation element | 0.25 |

In an embodiment in which the interior and exterior frame members are made of aluminum, the insulation element being made of polypropylene, a ratio of the thermal conductivity of the materials may be as high as 2050:1. In another embodiment in which the interior and exterior frame members are made of a magnesium alloy, the insulation element being made of nylon, a ratio of the thermal conductivity of the materials may be as low as 280:1. In other embodiments using aluminum with polypropylene or PVC, the ratio of the thermal conductivity of the materials may be in a range of 930:1 to 2050:1.

The insulation element 66 as shown in the example of FIGS. 10 and 11 has a generally rectangular cross-section and is traversed by two (2) elongated openings 80 that extend along a length of the insulation element 66. The openings 80 may be filled with air. This particular non-limitative construction of the insulation element 66 is easily obtained by an extrusion process and at once confers rigidity and thermal characteristics to the insulation element 66.

Figure 19:
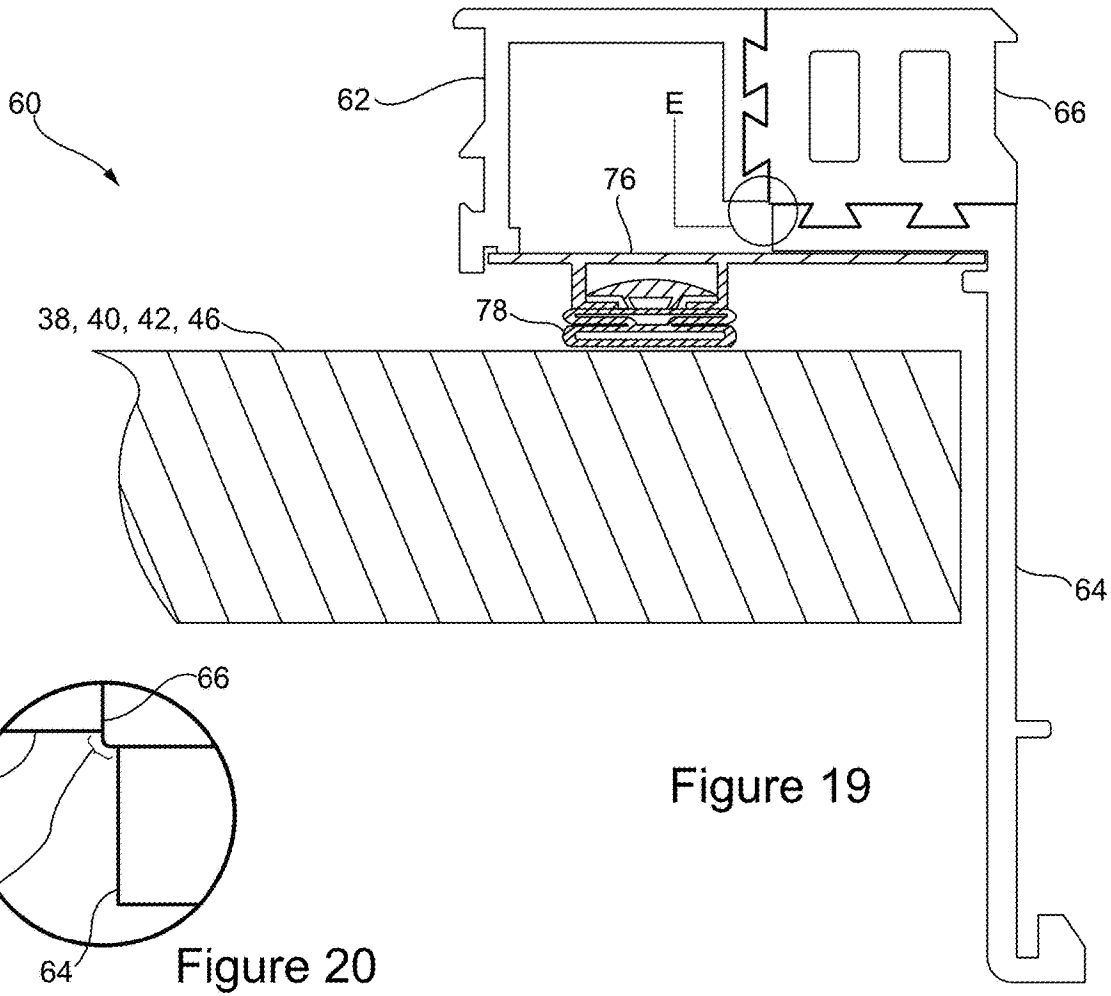
FIG. 19 is another top plan, cutaway view of the insulated frame section of FIG. 2 further showing a gasket, a gasket retainer and the end of a closed door abutting on the gasket.

FIG. 19 is another top plan, cutaway view of the insulated frame section of FIG. 2 further showing a gasket, a gasket retainer and the end of a closed door abutting on the gasket. As shown on FIG. 19, an elongate gasket retainer 76 is mounted between the interior and exterior frame members 62, 64. The gasket retainer 76 may be made of the same material as used for the insulation element 66 or of a different material also having a low thermal conductivity, for example a plastic. An elongate gasket 78, for example made of rubber, is mounted to the gasket retainer 76. One of the rails 38, 40 or one of the stiles 42, 46 of the door 32 may rest on the gasket 78, depending on the location of the insulating frame section 60 on the door frame 34 of FIG. 2.

Figure 20:
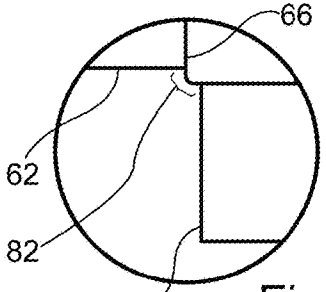
FIG. 20 is a detailed view of FIG. 19 at area E.

FIG. 20 is a detailed view of FIG. 19 at area E. As may be observed considering FIG. 20, there is no direct physical contact between the interior frame member 62 and the exterior frame member 64, these frame members 62, 64 being connected indirectly via the insulation element 66. A gap 82 is present between the interior and exterior frame members 62, 64. The interior frame member 62 and the exterior frame member 64 are also indirectly connected by the gasket retainer 76 which also has a low thermal conductivity. As such, no thermal bridge reduces the effectiveness of the insulation provided by the insulation element 66.

Returning now to FIG. 2, the refrigerator door system 30 includes the door frame 34 which is constructed of a number of insulated frame sections 60. For a single door 32, the door frame 34 would comprise four (4) insulated frame sections 60, two (2) of which would be mounted horizontally and two (2) of which would be mounted vertically. There is no a priori limit to the size of the door frame 34 or to the number of doors 32 that may be mounted in the refrigerator door system 30. In the example of FIG. 2, each pair of doors 32 is mounted so that door handles 48 of the pair are in close proximity when the doors 32 are closed, the hinges 44 for the pair of doors 32 being mounted in opposite corners of the door frame 34. In a variant, all doors 32 could open in the same direction. While no vertical insulated frame sections 60 are shown between each doors 32 of a pair, it is contemplated that additional insulated frame sections 60 may be installed in the door frame 34 so that the stiles 46 may rest on a gasket 78 when the doors 32 are closed.

Those of ordinary skill in the art will realize that the description of the insulated frame sections and refrigerator door systems are illustrative only and are not intended to be in any way limiting. Other embodiments will readily suggest themselves to such persons with ordinary skill in the art having the benefit of the present disclosure. Furthermore, the disclosed insulated frame sections and refrigerator door systems may be customized to offer valuable solutions to existing needs and problems related to condensation and to waste of energy in commercial refrigerators. In the interest of clarity, not all of the routine features of the implementations of the insulated frame sections and refrigerator door systems are shown and described. In particular, combinations of features are not limited to those presented in the foregoing description as combinations of elements listed in the appended claims form an integral part of the present disclosure. It will, of course, be appreciated that in the development of any such actual implementation of the insulated frame sections and refrigerator door systems, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of refrigeration equipment having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. An insulated frame section, comprising:

an elongate interior frame member;

an elongate exterior frame member; and an elongate insulation element having a generally rectangular cross-section, the insulation element having a first side connected to the interior frame member and a second side adjacent to the first side, the second side being connected to the exterior frame member, the insulation element preventing any direct physical contact between the interior and exterior frame members;

wherein a gap is defined between the interior frame member and the exterior frame member at a junction between the first side and the second side of the insulation element; and wherein a junction between a third side and a fourth side of the insulation element defines an external corner of the frame section.

2. The frame section of claim 1, wherein at least one of the interior and exterior frame members is made of a material having a first level of thermal conductivity and wherein the insulation element is made of a material having a second level of thermal conductivity, the first level of thermal conductivity being greater than the second level of thermal conductivity.

3. The frame section of claim 2, wherein a ratio of the first level of thermal conductivity over the second level of thermal conductivity is in a range between about 280 to about 2050.

4. The frame section of claim 2, wherein a ratio of the first level of thermal conductivity over the second level of thermal conductivity is in a range between about of 930 to about 2050.

5. The frame section of claim 1, wherein at least one of the interior and exterior frame members and the insulation element is an extrusion.

6. The frame section of claim 1, wherein the insulation element is connected to the interior frame member and to the exterior frame member by dovetail joints.

7. The frame section of claim 1, wherein:

the exterior frame member has a L-shaped cross-section defining a first segment between a first end-point and a corner of the L-shaped cross-section and a second segment between the corner and a second-end-point of the L-shaped cross-section, the first segment of the exterior frame member being connected to the second side of the insulation element so that the first end-point is proximal to the gap, the second segment of the exterior frame member extending away from the insulation element; and the interior frame member has a U-shaped cross-section defining two sides and a bottom connecting the two sides, the interior frame member being connected to the first side of the insulation element at a first of the two sides of the U-shaped cross-section so that a junction between the bottom and the first of the two sides of the U-shaped cross-section is distal from the gap.

8. The frame section of claim 7, further comprising an elongate gasket retainer mounted between a second of the two sides defined in the U-shaped cross-section of the interior frame member and the corner defined in the L-shaped cross-section of the exterior frame member, the gasket retainer being separated from the insulation member by the first segment of the exterior frame member, the gasket retainer being made of an insulating material.

9. The frame section of claim 8, wherein the gasket retainer is made of plastic.

10. The frame section of claim 8, further comprising an elongate gasket mounted to the gasket retainer on a face of the gasket retainer opposite from the first segment of the exterior frame member.

11. A refrigerator door system, comprising:

a door frame comprising four frame sections as claimed in claim 1, the four frame sections being assembled to form a rectangular opening; and a door mounted to the door frame, the door comprising a transparent window mounted between a pair of stiles and a pair of rails.

12. The refrigerator door system of claim 11, further comprising a pair of hinges adapted for mounting the door to the door frame.

13. The refrigerator door system of claim 11, wherein the hinges of the pair are mounted to top and bottom exterior corners of a same side of the door, the hinges of the pair being further connected to top and bottom horizontal frame sections in interior corners of the door frame.

14. A refrigerator door system, comprising:

a door frame comprising four frame sections as claimed in claim 1, the four frame sections being assembled to form a rectangular opening; and two doors, each door comprising a pair of hinges adapted for mounting the door to the door frame, each door further comprising a transparent window mounted between a pair of stiles and a pair of rails, the two doors being mounted to the door frame so that their respective hinges are on opposite corners of the door frame.

* * * * *